US006094837A

United States Patent [19]

Cantor

[11] Patent Number: 6,094,837

[45] Date of Patent: Aug. 1, 2000

[54] MULTI-FUNCTIONAL HAND-HELD HAIR DRYER

[75] Inventor: Josef Cantor, Greenville, S.C.

[73] Assignee: Jōshé, LLC, Greenville, S.C.

[21] Appl. No.: 09/303,976

[22] Filed: May 3, 1999

[51] Int. Cl.[7] ..... A45D 20/10

[52] U.S. Cl. ..... 34/97; 34/98

[58] Field of Search ..... 34/90, 91, 96, 34/97, 98; 392/380, 383, 384, 385

[56] References Cited

U.S. PATENT DOCUMENTS

| | | | |
|---|---|---|---|
| 4,198,556 | 4/1980 | Crowley et al. | 219/370 |
| 4,198,557 | 4/1980 | Crowley | 219/370 |
| 4,198,558 | 4/1980 | Benty | 219/370 |
| 5,148,512 | 9/1992 | Owens | 392/383 |
| 5,157,757 | 10/1992 | McDougall | 392/383 |
| 5,344,314 | 9/1994 | Zagoroff et al. | 432/222 |
| 5,467,540 | 11/1995 | Bastien | 34/97 |
| 5,507,103 | 4/1996 | Merritt | 34/97 |
| 5,598,640 | 2/1997 | Schepisi | 34/97 |
| 5,661,910 | 9/1997 | Schepisi | 34/97 |
| 5,842,286 | 12/1998 | Cantor | 34/96 |

*Primary Examiner*—Pamela A Wilson
*Attorney, Agent, or Firm*—Terry T. Moyer

[57] ABSTRACT

A multifunctional hand-held hair dryer is provided having a body section containing a motor and fan for generating a stream of air, a handle attached to the body in an essentially gun-type configuration, and a barrel attached to the body at a substantially right angle to the handle section, the interior walls of the barrel defining a central chamber through which air is transferred from the body to an end opening of the barrel and wherein there is attached to the exterior of the barrel styling attachments which together with the barrel surface form a chamber which may communicate hot air through holes in the styling attachment, the attachment and the holes together serving to facilitate styling of the hair.

9 Claims, 5 Drawing Sheets

MULTI-FUNCTIONAL HAND-HELD HAIR DRYER

FIELD OF THE INVENTION

The present invention relates to a portable, hand-held hair dryer which may be used to both dry the user's hair in the manner of a typical blower/dryer and to style the hair in the manner of a conventional styler/dryer.

BACKGROUND OF THE PRIOR ART

Portable hand-held hair dryers with heated air outputs have been used extensively by professional barbers and beauticians as well as by individuals in the home for many years. Such dryers typically have a cylindrical barrel portion from which the hot air exits axially out of one end. The air outlet opening is relatively small and thus provides a flow of high velocity concentrated air. With the high velocity air flow, the temperatures used in such blower/dryers can be relatively high without creating a risk of internal heat build-up by the heating elements and as such, the drying power of these devices is quite high. The most common configuration of this type is the gun-type unit in which a handle portion extends downwardly at a right angle from a cylindrical barrel portion. A motor and a centrifugal fan are positioned at the junction of the handle and body portion. Electrical heating elements are provided between the fan and the frontally located air outlet.

If brushing or combing is desired for styling of the hair, however, both hands must be used with the dryer being held in one hand and a comb or brush in the other. This presents a generally inconvenient and cumbersome task for an individual attempting to style his or her own hair. Where a second person, such as a professional hair stylist, is performing the simultaneous drying and styling function using two hands, the task may be less inconvenient, but the high velocity, high temperature air flow out of the barrel outlet opening may undesirably blow or scatter the hair and hinder styling of the hair. Also, such hair dryers may dry the hair too quickly or may even overdry the hair while it is being styled to such an extent that it may be damaged by the removal of necessary oils or by protein degradation within the matrix of the hair shafts themselves.

In response to these disadvantages, as disclosed in U.S. Pat. No. 5,469,540 to Bastian, there have been developed in the prior art various forms of diffusers for attenuating the hot air blast from hair dryers. Some of these devices comprise baffling structures that are removably secured to the output end of the hair dryer tube. Such devices are inconvenient to store and install, and removal of the device after use may be hazardous, due to the possibility of sustaining burns from the heated surfaces. Other arrangements include umbrella-like arrangements for partially blocking air flow, a system that is mechanically complicated and prone to mechanical failure. Likewise, some diffusers have employed rotating vanes to partially constrict the output orifice, but the resulting effect is to increase the velocity of the air stream. The prior art indicates a lack of a reliable device for selectively diffusing the air blast of a hair dryer.

Yet another approach to solving the problems associated with conventional, hand-held hair dryers has been the so-called styler/dryer appliance. Such appliances typically have an elongated body with a head portion in which the hot air flow exits laterally therefrom. The styling function may be facilitated by the presence of various styling attachments, such as one or more brushes or combs and may be manipulated in the same fashion as is a common brush with one's hair being dried and styled as the user merely brushes or combs his or her hair. A typical construction of a styler/dryer incorporates a tangential fan within the head portion thereof with the heating elements being positioned between the fan and the lateral air outlet. The air outlet contained in styler/dryers is of a larger area than that of the typical blower/dryer and consequently the air exits through this outlet at a lower velocity. This lower velocity and less concentrated air flow will not tend to adversely blow or scatter the user's hair as much as the high velocity air in the blower/dryer, thereby facilitating the styling operation. Such styler/dryer appliances, however, typically lack the high velocity, high temperature air flow of conventional dryers preferred to initially dry the hair to prepare it for styling in a second step where the drying of the hair may be simultaneously completed. In view of these considerations, it would be advantageous to have a single, portable hand-held product that would provide the functions and advantages of both a blower/dryer appliance as well as a styler/dryer appliance.

Prior efforts to provide the combined functions of a blower/dryer and a styler/dryer appliance in one hand-held unit have been suggested. More particularly, the idea of a hair blower having means for delivering the air outwardly through the end of the barrel or blocking the end of the barrel and causing the air to flow out the side of the barrel are, in general known.

For instance, U.S. Pat. Nos. 5,661,910 and 5,598,640, both issued to Schepisi, disclose a hand-held blow dryer in which the air may be directed axially through the end of a barrel, or the end may be closed by deflectors, causing the air to be directed radially out of the barrel through holes.

U.S. Pat. Nos. 4,198,556; 4,198,557; and 4,198,558, all assigned to Sunbeam Corporation, disclose a hair blower which may be used in a gun configuration with air flowing out through the end, or may be used with the handle in line with the barrel so that air is blocked from going out the end and goes out the side for use as a styler/dryer.

U.S. Pat. Nos. 5,148,512 and 5,157,757 both disclose other arrangements for a hair dryer in which air flow may pass through the end or through the sides of the barrel.

These prior efforts to provide a multifunctional unit, however, may be in general characterized by having many moving parts to either direct the air out of the barrel end or alternatively out of the sides of the barrel. Such moving parts add complexity and cost to the construction of the units which are typically mass marketed and price sensitive. Additionally, such moving parts tend to break, especially where they are used in association with the materials typically used in the construction of mass marketed hair dryers.

In my U.S. Pat. No. 5,842,286, issued Dec. 1, 1998 (incorporated by reference), I describe a hair drying appliance which can be used as a gun-type blower/dryer and as an elongated styler-dryer without the necessity of employing complicated additional moving parts or attachments. The blow dryer arrangement described in my prior U.S. patent adds functionality to the appliance by allowing simultaneous airflow from the barrel surface as well as from the barrel end allowing its use for horizontal lifting/drying/styling as well as a hot roller and diffuse. The appliance of my earlier patent is provided with at least two chambers which service to control the relative velocity and uniformity of hot air exiting through holes in the periphery of the barrel on the one hand and at the barrel end opening on the other hand.

SUMMARY OF THE INVENTION

A multifunctional hand-held hair dryer is provided, comprising: a body containing a motor and fan for generating a high velocity air stream; a handle attached to the body; a barrel attached to the body at a substantially right angle to the handle section, the interior walls of said barrel defining a central chamber through which air may be transferred from the body axially to a barrel end opening, said barrel further being provided with means on the exterior surface thereof for removably attaching styling attachments having an inner surface, the barrel surface and the inner surface of the styling attachments together forming one or more peripheral chambers running substantially along the axis of the barrel; one or more openings in the barrel which allow air to flow from the central chamber to the peripheral chambers; and one or more openings in said styling attachments to allow air to exit the peripheral chambers at a desired temperature and velocity to facilitate styling of hair by means of the styling attachments.

The appliance of the present invention may further be used as a conventional blower/dryer without any of the disadvantages typically associated with the known multi-functional appliances by simply replacing the styling attachments with a blank attachment, that is one having no openings in it thereby preventing air from exiting along the periphery of the barrel, directing substantially all of the air through the barrel end opening.

The openings along the periphery of the barrel may be positioned in a wide range of locations along the barrel so long as they function to transfer air from the central chamber of the barrel to the peripheral chambers formed by the barrel surface and the inner walls of the styling attachments. It is to be noted, however, that in most conventional appliances the air flow which is generated in the body portion of the dryer by a fan and motor located there is actually heated by an electrical heating element located in the barrel of the dryer over which the air flows prior to exiting the dryer at the barrel end opening. Thus the position of the opening along the periphery of the barrel may vary depending upon the temperature desired for the air exiting through the styling attachments to be used in styling of the hair during the final drying process.

If it is desired that the air to be used in the styling function is at substantially the same temperature as that which exits the barrel end opening, the openings should be on the periphery of the barrel at or near the end opening. If on the other hand it is desired that the air be at a significantly lower temperature the openings may advantageously be positioned on the barrel at or near the base of the barrel where it is connected to the body portion thereof as generally disclosed in my U.S. Pat. No. 5,842,286. Permissible further variations for the location of the openings will be readily envisioned by those skilled in this art.

Further objects and advantages of the invention will become apparent as the following description proceeds and features of novelty which characterize the invention will be pointed out with particularity in the claims annexed to and forming a part of this specification.

DETAILED DESCRIPTION OF THE DRAWINGS

Figure 1:
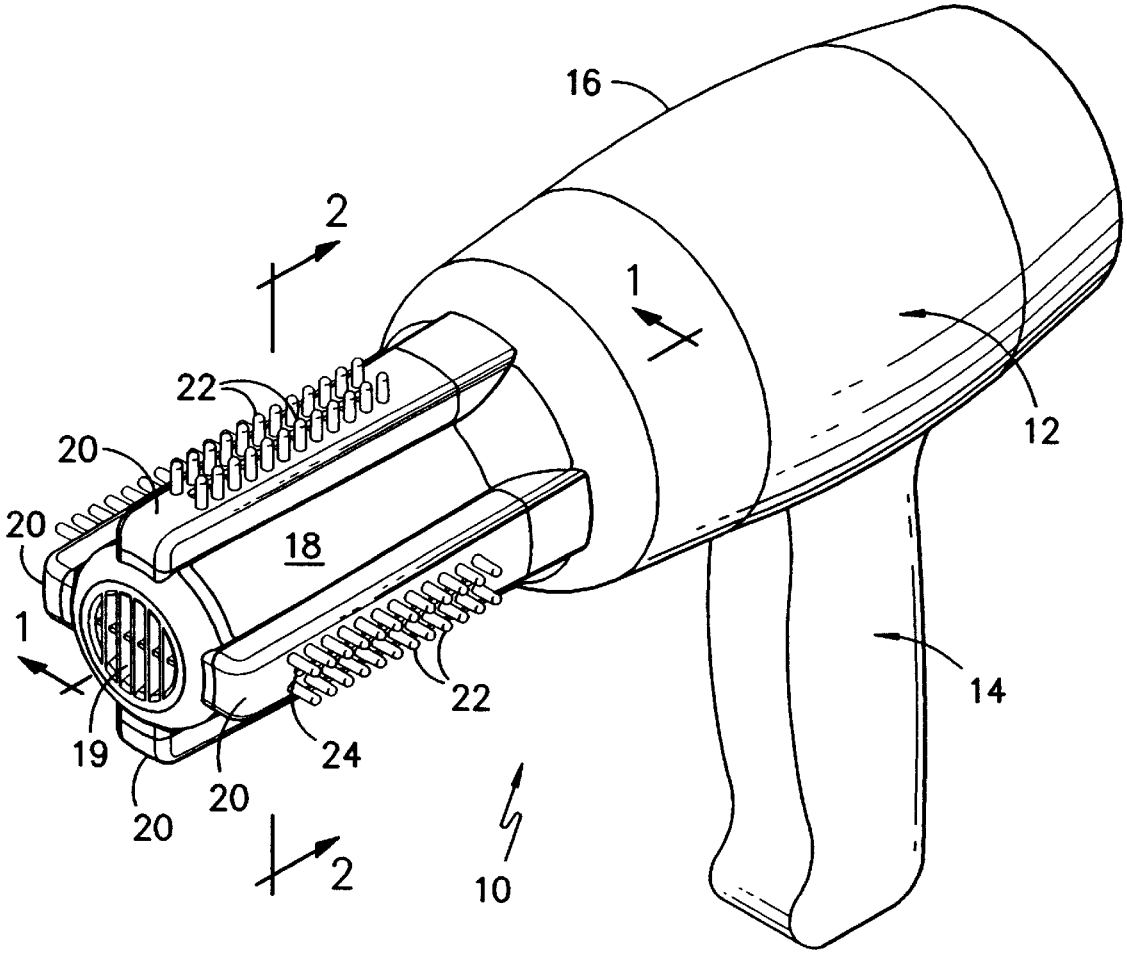
FIG. 1 is a perspective view of the hair drying appliance embodying the present invention.

Referring now to the drawings, there is shown in FIG. 1 a hair dryer appliance designated generally by reference number 10. The hair dryer as shown is a gun-type configuration having a plastic housing 12. The dryer is provided with a conventional handle section 14, a cylindrical body housing 16. A motor and centrifugal fan (not shown) are positioned in body housing 16. Connected to body housing 16 is barrel section 18 which is provided with a barrel end opening 19. Positioned within barrel section 18 is a heating element (not shown). Removably attached to barrel section 18 are four styling attachments 20 having teeth 22 and openings 24 extending axially along the styling attachment. Not shown are openings in the barrel periphery which serve to transfer the flow of hot air from the central chamber of barrel 18 into peripheral chambers formed by the barrel exterior surface and the interior surface of styling attachments 20. As will be apparent to those skilled in the art the configuration of the styling attachments may vary widely; they may be rigid (as shown), or flexible and may vary in length. It is one of the advantages of the present invention that in a single dryer, if desired, a wide variety of attachments may be provided to accomplish a wide variety of desirable styling results.

Figure 2:
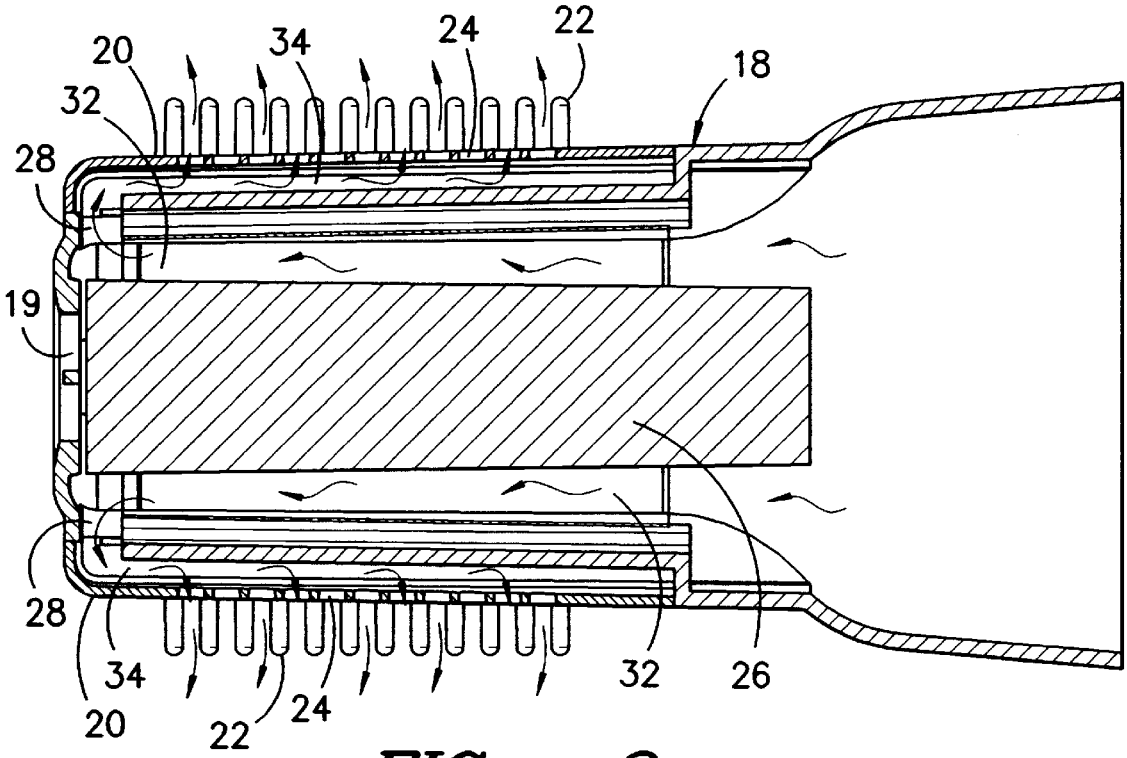
FIGS. 2 and 3 are cross-sectional views taken generally along lines 1—1 and 2—2 of FIG. 1.

FIG. 2 is a cross-sectional view of barrel 18 taken along lines 1—1 of FIG. 1. In FIG. 2 heating element 26 is shown extending axially along the interior of barrel 18 to approximately the location of barrel end opening 19. FIG. 2 shows peripheral openings 28 in barrel 18 near the barrel end opening 19. Openings 28 serve to allow air which has been heated by means of heating element 26 as it travels through central chamber 32 of barrel 18 to flow into peripheral chambers 34 and then through openings 24 in styling attachments 20. The relative positioning and design of openings 24 and teeth 22 may vary widely and will be readily apparent to those skilled in the art based in part on the design features found in conventional styler/dryers.

Figure 3:
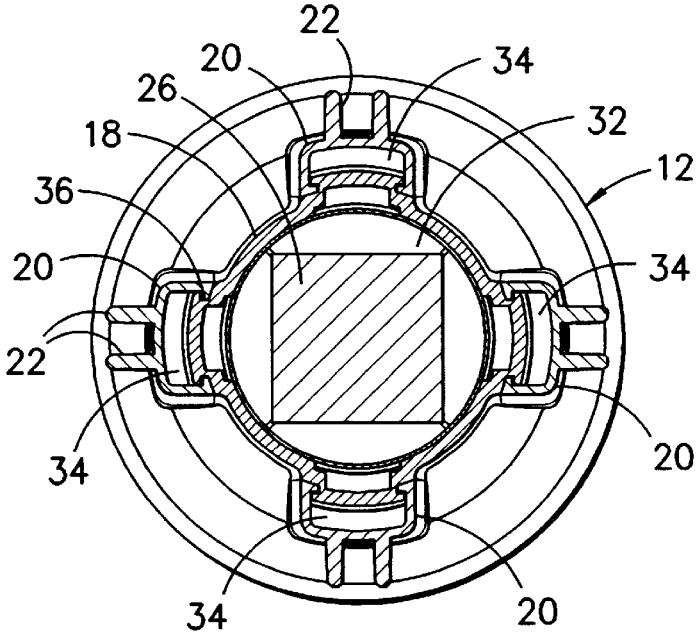

FIG. 3 is a cross sectional view taken along lines 2—2 of FIG. 1. As shown, heating element 26 is positioned in the central chamber 32 and is attached to the interior walls of barrel 18 attached to plastic housing 12. Styling attachments 20 are removable attached to barrel 18 by means of grooves 36 in barrel 18 and may be removed by sliding the styling attachments 20 axially along the barrel in a direction away from plastic housing 12. The interior walls of styling attachment 20 and barrel 18 define peripheral chambers 34.

Figure 4:
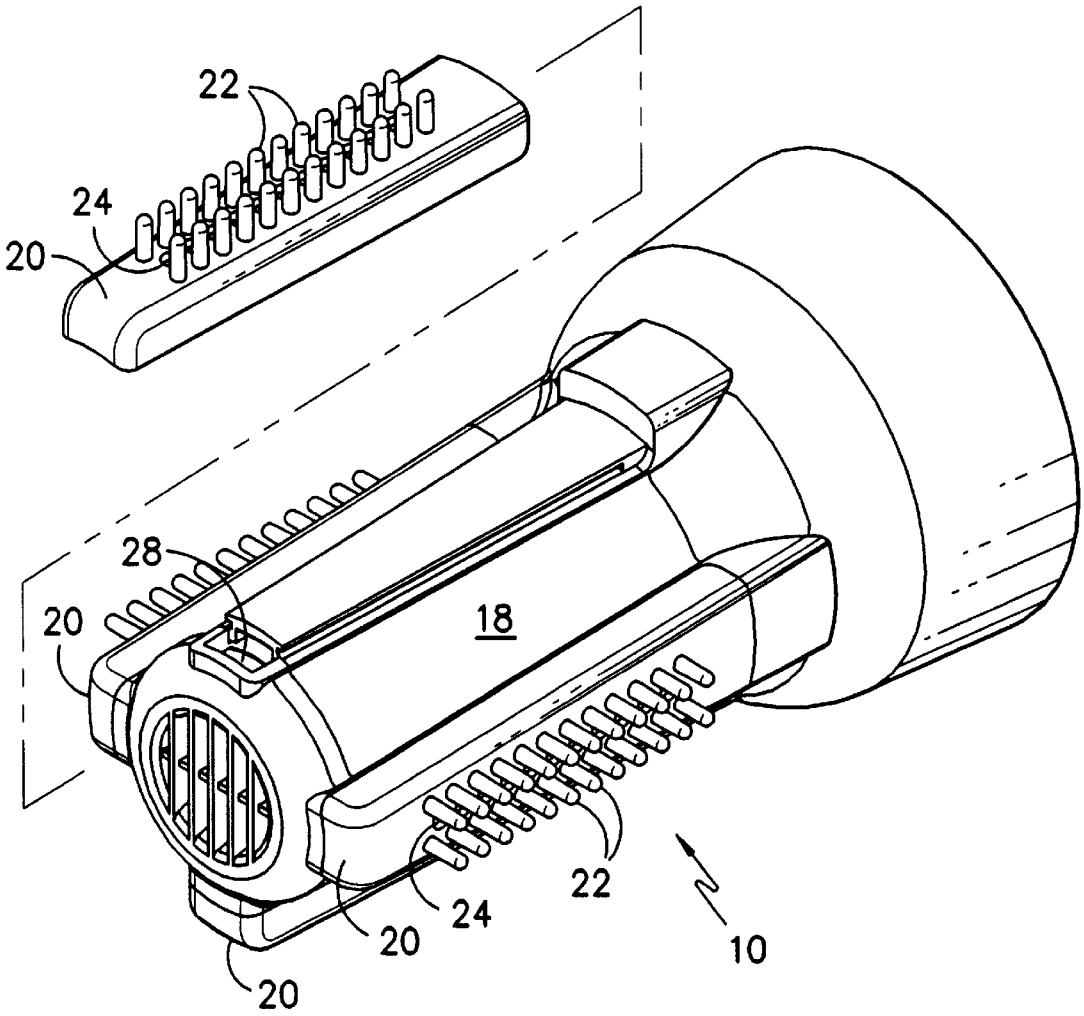
FIG. 4 is a perspective view of the appliance with one of the styling attachments removed to reveal the attachment mechanism on the barrel and the opening on the periphery of the barrel (near the barrel end opening) which serves to communicate air flow from the central chamber to the peripheral chamber.

FIG. 4 is a perspective view of the hair dryer appliance 10 shown in FIG. 1 with one of the four styling attachments 20 removed from barrel 18 to clearly illustrate the configuration of peripheral opening 28 in barrel 18 which allows air to flow into the peripheral chambers and ultimately through holes 24 thereby facilitating the styling function.

Figure 5:
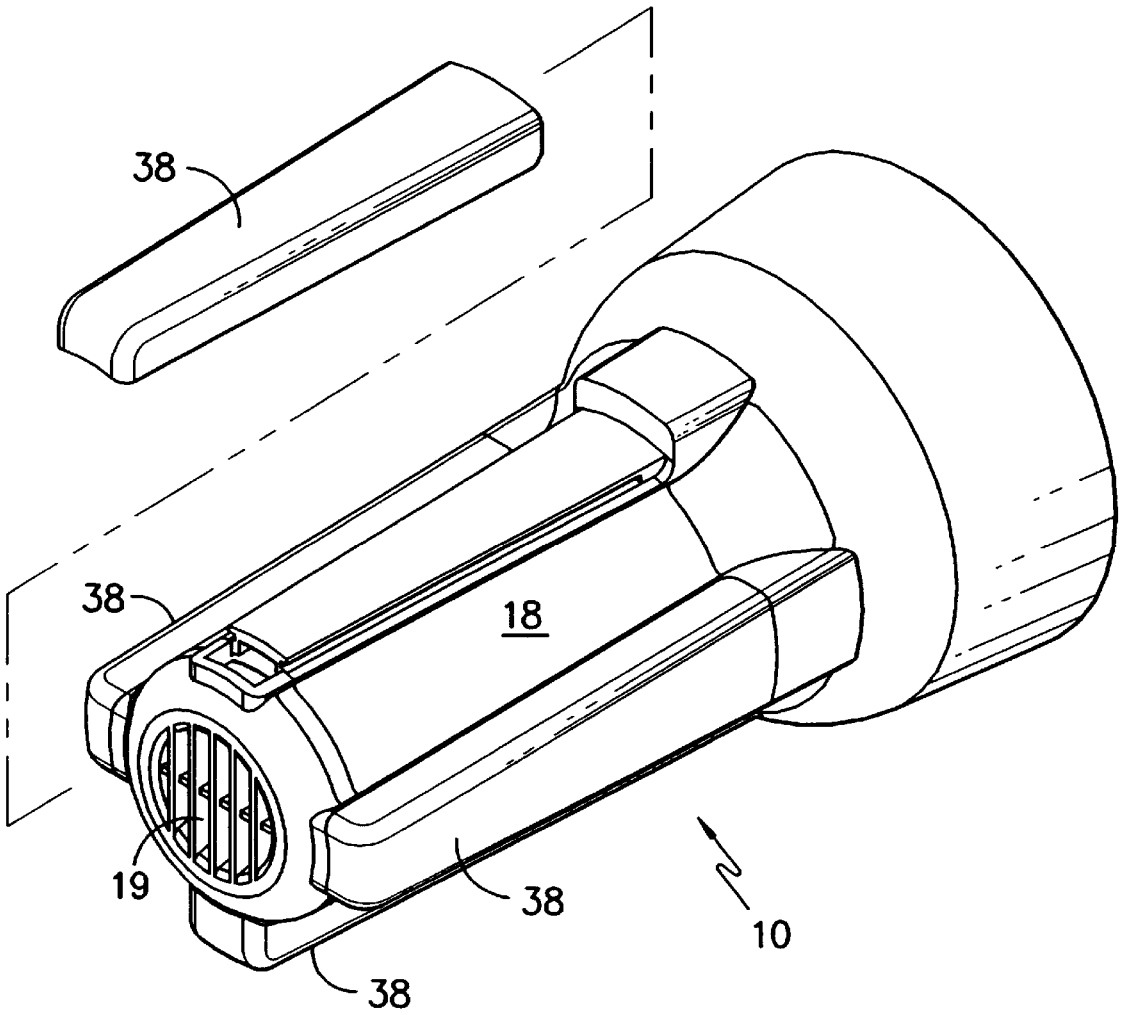
FIG. 5 is a perspective view of the appliance showing blank attachments on the periphery whereby the dryer functions as a conventional blower/dryer.

FIG. 5 again illustrates in perspective the basic dryer design of barrel 18 shown in FIG. 1 with the exception that the dryer is shown in a conventional blower/dryer configuration. As shown, the styling attachments have been replaced with blanks 38 preventing hot air from escaping along the periphery of the barrel (through the peripheral chambers) and forcing all of the hot air to exit the dryer at barrel end opening 19. One of the blank 38 has been removed to show the underlying configuration of barrel 18 which will be readily understood by those skilled in this art.

Figure 6:
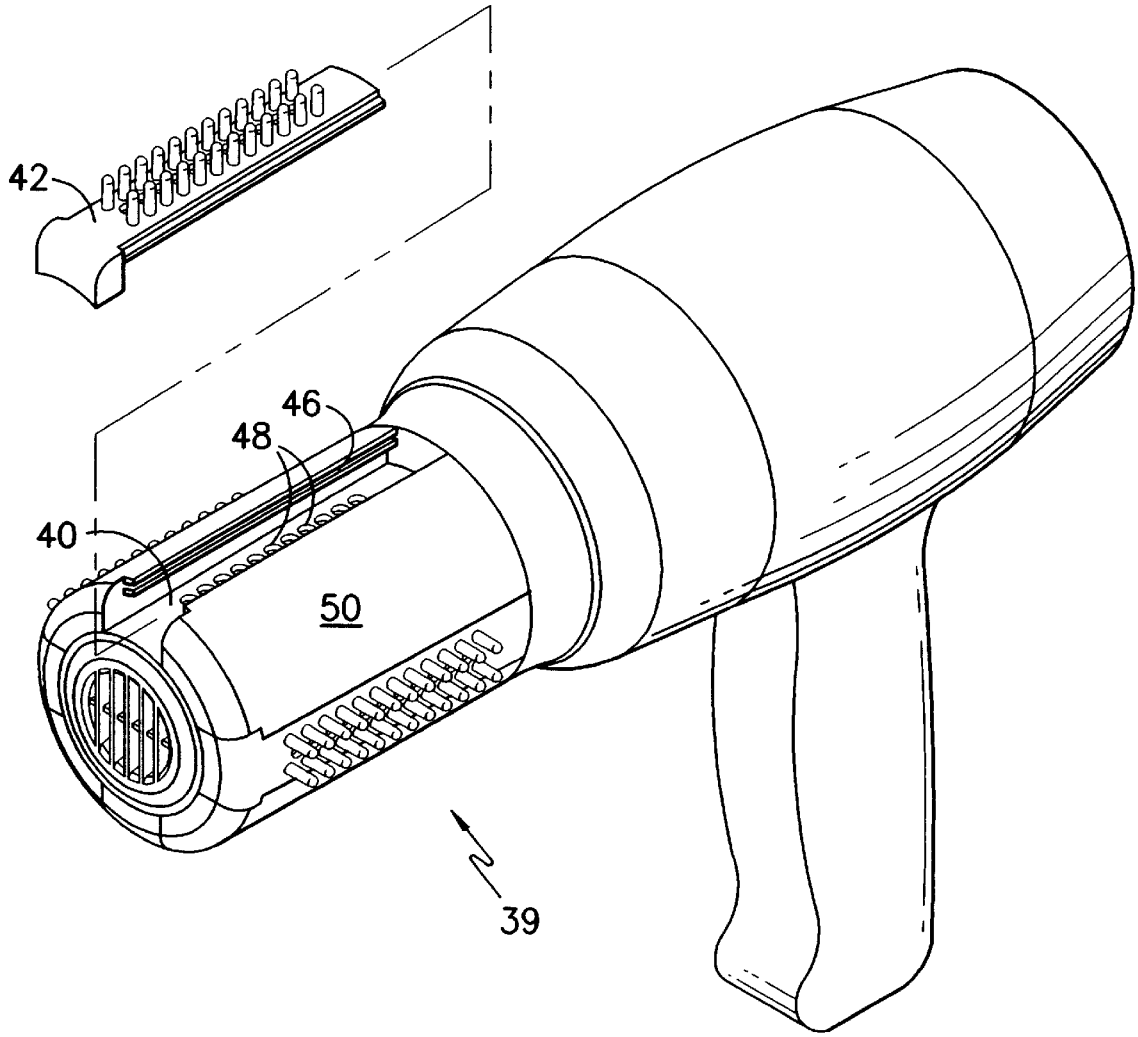
FIG. 6 is a perspective view of an alternative embodiment of the invention wherein the peripheral chambers are formed by recesses in the exterior of the barrel and the styling attachments, when in place together with the barrel form a substantially normal circular barrel circumference and there are a plurality of peripheral openings formed along the axial direction of the barrel through which air may be transferred from said central chamber to said peripheral chambers.

FIG. 6 is a perspective view of an alternative hair dryer 39 wherein barrel 18 has been provided with recesses 40 such that when styling attachment 42 is slid into place through grooves 46 a peripheral chamber is formed through which hot air may flow through peripheral holes 48 extending axially along the length of barrel 50 of dryer 39. As shown in hair dryer 39, the barrel 50 and styling attachment 42 are configured to provide a generally circular cross-section to the exterior of the dryer which may be desired for certain applications.

While there has been shown and described a two embodiments of the present invention, it will be apparent to those skilled in the art that numerous changes and modifications may be made without departing from the invention in its broader aspects and it is, therefore, contemplated in the appended claims to cover all such changes and modifications which fall within the true spirit and scope of the present invention.

What is claimed is:

1. A multifunctional hand-held hair dryer, comprising: a body containing a motor and fan for generating a high velocity air stream; a handle attached to the body; a barrel attached to the body at a substantially right angle to the handle section, the interior walls of said barrel defining a central chamber through which air may be transferred from the body axially to a barrel end opening, said barrel further being provided with means on the exterior surface thereof for removable attaching styling attachments having an inner surface, the barrel surface and the inner surface of the styler attachments together forming at least one peripheral chamber running substantially along the axis of the barrel; at least one opening in the barrel which allows air to flow from the central chamber to the peripheral chambers; and at least one opening in said styling attachments to allow air to exit the peripheral chambers to facilitate styling of hair by means of the styling attachments.

2. The multifunctional hand-held hair dryer of claim 1 wherein said styling attachments have been replaced with blank attachments having no openings therein whereby the dryer functions as a conventional dryer.

3. The multifunctional hand-held hair dryer of claim 1 wherein the said peripheral opening on the barrel is located near the barrel end opening to facilitate heating of air which will be directed into the peripheral chambers to be used in connection with the styling function.

4. The multifunctional hand-held hair dryer of claim 1 wherein said peripheral openings are positioned on the barrel near where said barrel is connected to a body portion of the dryer whereby air is directed into said peripheral chambers.

5. A multifunctional hand-held hair dryer comprising: a body containing a motor and fan for generating an air stream; a handle attached to said body; a barrel attached to said body, the interior walls of said barrel defining a central chamber through which air is transferred from the body in a generally axially direction through said barrel to a barrel end opening, said barrel further being provided with means for removable attaching styling attachments having an inner surface, the barrel surface and said inner surface of said styling attachments together forming at least one peripheral chamber running along the axis of said barrel; said barrel having at least one opening on the periphery thereof which functions to transfer air from said at least one central chamber to said peripheral chamber, each of said styling attachments furthermore being provided with at least one opening to allow air to exit said at least one peripheral chambers.

6. The multifunctional hand-held hair dryer of claim 5 wherein said styling attachments have been replaced with blank attachments having no openings therein whereby the dryer functions as a conventional dryer.

7. The multifunctional hand-held hair dryer of claim 5 wherein the said peripheral opening on the barrel is located near the barrel end opening to facilitate heating of air which will be directed into the peripheral chambers to be used in connection with the styling function.

8. The multifunctional hand-held hair dryer of claim 5 wherein said peripheral openings are positioned on the barrel near where said barrel is connected to the body portion of the dryer whereby air is directed into said peripheral chambers.

9. A multifunctional hand-held hair dryer, comprising: a body containing a motor and a fan for generating an air stream; a handle attached to said body; a barrel attached to said body, the interior walls of said barrel defining a central chamber through which air may be transferred from said body axially to a barrel end opening, said barrel further being provided with means on the exterior surface thereof for removable attaching styling attachments having an inner surface, the barrel surface and the inner surface of the styling attachments together forming at least one peripheral chambers, wherein the peripheral chambers are formed by recesses in the exterior of the barrel and said styling attachments when in place together with the barrel form a substantially normal circular barrel circumference; a plurality of peripheral openings along the axial direction of the barrel through which hot air may be transferred from said central chambers to said peripheral chambers; each of said styling attachments being provided with at least one opening to allow air to exit said peripheral chambers.

* * * * *